US012529172B1

(12) United States Patent
Wang et al.

(10) Patent No.: US 12,529,172 B1
(45) Date of Patent: Jan. 20, 2026

(54) MICRO-TEXTURED PET-HAIR-RESISTANT YOGA FABRIC

(71) Applicant: FULL SCALE FULL SPEED PTE.LTD., Singapore (SG)

(72) Inventors: Yong Wang, Singapore (SG); Xiaopei Zhang, Singapore (SG); Li Shi, Singapore (SG); Dandan Zhang, Singapore (SG); Mianchun Huang, Singapore (SG)

(73) Assignee: FULL SCALE FULL SPEED PTE.LTD., Singapore (SG)

( * ) Notice: Subject to any disclaimer, the term of this patent is extended or adjusted under 35 U.S.C. 154(b) by 0 days.

(21) Appl. No.: 19/089,011

(22) Filed: Mar. 25, 2025

(30) Foreign Application Priority Data

Jan. 22, 2025 (CN) ..... 202510106631.X

(51) Int. Cl.

| | |
|---|---|
| ***D04B 1/10*** | (2006.01) |
| ***D04B 1/04*** | (2006.01) |
| ***D04B 1/12*** | (2006.01) |
| ***D04B 1/24*** | (2006.01) |

(52) U.S. Cl.
CPC ..... *D04B 1/102* (2013.01); *D04B 1/04* (2013.01); *D04B 1/12* (2013.01); *D04B 1/24* (2013.01)

(58) Field of Classification Search
CPC . D04B 1/12; D04B 1/102; D04B 1/20; D04B 1/24; D04B 1/04; D04B 1/06; D04B 1/10; D04B 7/04; D04B 7/24; D04B 7/28; D04B 9/38
See application file for complete search history.

(56) References Cited

U.S. PATENT DOCUMENTS

| | | | | | |
|---|---|---|---|---|---|
| 2,379,649 | A * | 7/1945 | Nebel | D04B 9/02 | 66/97 |
| 3,937,041 | A * | 2/1976 | Balcombe | D04B 1/102 | 66/197 |
| 3,964,277 | A * | 6/1976 | Miles | D04B 1/123 | 66/190 |
| 3,971,234 | A * | 7/1976 | Taylor | D04B 1/126 | 66/196 |
| 4,019,350 | A * | 4/1977 | Schmidt | D04B 1/102 | 66/196 |
| 4,079,602 | A * | 3/1978 | Blore | D04B 1/14 | 66/196 |
| 4,229,954 | A * | 10/1980 | Blore | D04B 1/102 | 66/196 |
| 4,267,710 | A * | 5/1981 | Imamichi | D04B 1/12 | 66/196 |
| 4,353,229 | A * | 10/1982 | Hutchinson | D04B 1/24 | 66/197 |
| 4,891,958 | A * | 1/1990 | Cournoyer | D04B 1/104 | 66/196 |
| 5,033,276 | A * | 7/1991 | Strauss | D04B 1/10 | 66/196 |

(Continued)

*Primary Examiner* — Danny Worrell
(74) *Attorney, Agent, or Firm* — IPRTOP LLC

(57) ABSTRACT

Provided are a micro-textured pet-hair-resistant yoga fabric, a preparation method thereof, and its application in pet hair-resistant clothing. The micro-textured pet-hair-resistant yoga fabric can address the drawback that fiber clothes of consumers are prone to adhering to pet hair during human-pet interactions and it is difficult to clean, which can effectively minimize the pet hair adhesion.

1 Claim, 3 Drawing Sheets

(56) References Cited

U.S. PATENT DOCUMENTS 5,463,881 A * 11/1995 Igarashi ..... D04B 9/06
66/196
5,636,533 A * 6/1997 Hunneke ..... D04B 1/12
66/196

* cited by examiner

MICRO-TEXTURED PET-HAIR-RESISTANT YOGA FABRIC

FIELD OF TECHNOLOGY

The present disclosure belongs to the field of textiles, relates to a micro-textured pet-hair-resistant yoga fabric, particularly to a micro-textured pet-hair-resistant yoga fabric, a preparation method thereof, and its application in pet hair-resistant clothing.

BACKGROUND

Under today's hectic work schedules and immense life pressures, an increasing number of people are turning to fitness to improve their physical health. Consumers are also purchasing more sportswear tailored to their preferred fitness activities. It has been found that consumers from Generation X and the Millennial generation particularly gravitate toward comfortable and stylish yoga apparel. Typical yoga garments encompass yoga tops (such as yoga jackets and short-sleeved yoga tops), yoga vests, and yoga bottoms (including short yoga pants, long yoga pants, and mock two-piece yoga pants), among others.

With pet ownership becoming a prevailing trend and the pet-owning demographic continually expanding, owners face persistent challenges during close interactions with their pets—particularly in spring and autumn shedding seasons. Moments after cuddling their beloved pets, clothing becomes embedded with stubborn fur that resists brushing off, significantly burdening owners. This has driven strong consumer demand for anti-fur-adhesion garments. As a focus of cutting-edge technological innovation in the textile industry, fur-resistant fabrics have garnered significant market anticipation since their conceptual introduction.

Current research on fur-resistant fabrics predominantly focuses on addressing hair adhesion in synthetic fiber textiles, where electrostatic attraction caused by frictional charging is the primary mechanism of fiber-to-fabric attachment. Antistatic finishing techniques have proven effective in mitigating this issue. However, practical applications reveal that such electrostatically modified fabrics only demonstrate efficacy against charged hairs, showing minimal preventive effect on airborne fur contamination.

SUMMARY

The present disclosure provides a micro-textured pet-hair-resistant yoga fabric, which can address the drawback in the prior art that chemical fiber clothes are prone to adhering to pet hair, causing consumers to get a lot of hair stuck on their clothes during human-pet interactions and making it difficult to clean. Therefore, the present disclosure provides a micro-textured pet-hair-resistant yoga fabric based on structural innovation, a preparation method thereof, and its application in pet hair-resistant clothing.

The first aspect of the present disclosure provides a micro-textured pet-hair-resistant yoga fabric. The fabric features a double-faced two-needle-bed knitted structure comprising a plurality of minimum stitch repeat units, each minimum stitch repeat unit comprises 2 wale columns and 10-position course rows.

A structural unit formed by a first wale and the 10-position course rows is configured as follows: at positions 1, 4, 6, and 9 of the 10-position course rows, an upper needle forms loop-forming stitch units, and a lower needle forms float stitch units; at positions 3, 5, and 8, an upper needle forms float stitch units, and a lower needle forms loop-forming stitch units; at position 2, an upper needle forms a tuck stitch unit, and a lower needle forms a float stitch unit; at positions 7 and 10, an upper needle forms float stitch units, and a lower needle forms tuck stitch units.

A structural unit formed by a second wale and the 10-position course rows is configured as follows: at positions 1, 4, 6, and 9, an upper needle forms loop-forming stitch units, and a lower needle forms float stitch units; at positions 2 and 5, an upper needle forms float stitch units, and a lower needle forms tuck stitch units; at position 7, an upper needle forms a tuck stitch unit, and a lower needle forms a float stitch unit; at positions 3, 8, and 10, an upper needle forms float stitch units, and a lower needle forms loop-forming stitch units.

The second aspect of the present disclosure provides a preparation method for a micro-textured pet-hair-resistant yoga fabric, comprising the following steps:

1) knitting yarns to form a grey fabric;
2) sequentially processing the grey fabric through scouring, pre-setting, dyeing, color fixation, rinsing, and post-setting to obtain a required fabric.

The third aspect of the present disclosure provides the use of a micro-textured pet-hair-resistant yoga fabric in pet-hair-resistant clothing.

As described above, the micro-textured pet-hair-resistant yoga fabric of the present disclosure can form a patterned microstructure comprising uniformly distributed three-dimensional pique-textured units alternating orthogonally with flat grid zones. There is a height difference between piqué-textured areas and flat zones. When pet hair adheres, the protruding piqué-textured areas directly interact with the hairs, while the flat zones remain non-contacting. Compared to smooth-surfaced fabrics such as plain weaves or double-knits, this fabric reduces direct contact area with pet hair by 50% and enhances hair removability through mechanical detachment. Additionally, the fabric exhibits wrinkle-resistant properties without ironing.

DETAILED DESCRIPTION

Figure 1:
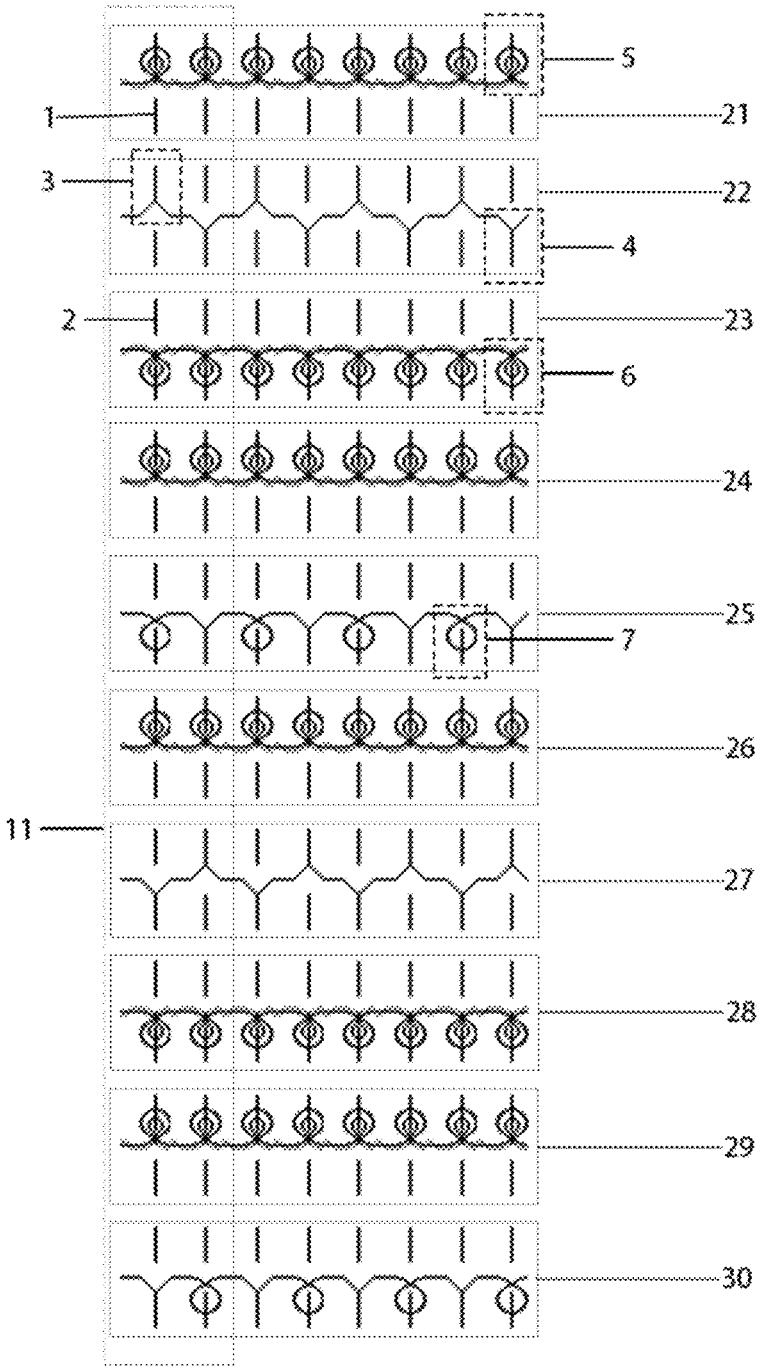
FIG. 1 is a stitch diagram of a micro-textured pet-hair-resistant yoga fabric in the present disclosure, where 1 represents the lower needle, 2 represents the upper needle; 3 represents the tuck stitch units knitted by the upper needle; 4 represents tuck stitch units knitted by the lower needle; 5 represents loop-forming stitch unit where two yarns are knitted simultaneously by the upper needle; 6 represents loop-forming stitch unit where two yarns are knitted simultaneously by the lower stitch; 7 represents loop-forming stitch unit where a single yarn is knitted by the lower needle; 11 represents a minimum repeat unit; 21-30 represent positions 1 to 10 of the 10-position course rows, respectively.

The following provides detailed descriptions of the embodiments of a micro-textured pet-hair-resistant yoga fabric of the present disclosure. However, certain detailed explanations may be omitted where appropriate. For example, detailed descriptions of well-known matters and repeated descriptions of substantially identical structures may be omitted. This is to prevent unnecessary prolixity in the following descriptions and to facilitate comprehension by those skilled in the art. In addition, the following descriptions are provided for those skilled in the art to fully understand the present disclosure and are not intended to limit the subject matter defined in the claims.

DEFINITION OF TERMS

Weft-knitted fabrics include but are not limited to three fabric structural units: loop-forming stitch units, tuck stitch units, and float stitch units (non-knitting). The loop-forming stitch units indicate full needle engagement where the knitting needle completes the entire loop-forming process, creating intermeshed loops. Thus, the loop-forming stitch units are also referred to as loop structural units. The tuck stitch units indicate half-needle engagement, representing single-yarn knitting where the needle captures yarn without loop casting off, forming arc-shaped yarn configurations over existing loops. The float stitch units indicate zero needle engagement, producing linear yarn floats on the fabric's technical back, alternatively termed non-knitting units.

In the knitted fabric, a row of loops aligned along the fabric's width is referred to as a course, while a column of vertically interlooped loops constitutes a wale. For an n-position course row (where n is a positive integer not less than 1), the positions are sequentially designated as position 1, position 2 . . . position n from left to right. Correspondingly, n wale columns (where n is a positive integer ≥1) are sequentially designated as wale 1, wale 2 . . . wale n from top to bottom.

The "range" disclosed in the present disclosure is defined in the form of a lower limit and an upper limit, where a specified range is bounded by selecting a lower boundary and an upper boundary. The range defined in this way may be inclusive or exclusive of the end values and may be combined arbitrarily. That is, any lower limit may be combined with any upper limit to form a range. For example, if ranges of 60-120 and 80-110 are listed for a particular parameter, it is understood that ranges of 60-110 and 80-120 are also contemplated. Furthermore, if minimum range values of 1 and 2 are listed, and maximum range values of 3, 4, and 5 are listed, the following ranges are all contemplated: 1-3, 1-4, 1-5, 2-3, 2-4, and 2-5. In the present disclosure, unless otherwise specified, the numerical range "a-b" represents an abbreviation for any combination of real numbers between a and b, wherein a and b are both real numbers. For example, the numerical range "0-5" means that all real numbers between "0-5" have been listed in this article, and "0-5" is just an abbreviation of these numerical combinations. In addition, when a parameter is expressed as an integer ≥2, it is equivalent to disclosing that the parameter is, for example, an integer of 2, 3, 4, 5, 6, 7, 8, 9, 10, 11, 12, etc.

Unless otherwise specified, all embodiments and optional embodiments of the present disclosure can be combined with each other to form a new technical solution.

Unless otherwise specified, all technical features and optional technical features of the present disclosure can be combined with each other to form a new technical solution.

Unless otherwise specified, all the steps of the present disclosure can be performed sequentially or in any arbitrary order, preferably sequentially. For example, a method comprising steps (1) and (2), indicates that the method may include steps (1) and (2) performed sequentially, or alternatively steps (2) and (1) performed sequentially. When the method is described as optionally comprising step (3), it indicates that step (3) may be incorporated in any sequence permutation. For example, the method may include steps (1), (2), and (3), or may include steps (1), (3) and (2), or may include steps (3), (2) and (1), etc.

Unless otherwise specified, the terms "including" and "comprising" as used in the present disclosure shall be construed as either open-ended or closed-ended. For example, the terms "including" and "comprising" may indicate that additional unlisted components may also be encompassed, or may be limited to solely the explicitly listed components.

Unless otherwise specified, in the present disclosure, the term "or" is inclusive. For example, the phrase "A or B" shall be interpreted as "A, B, or both A and B." More specifically, any of the following conditions satisfies the requirement of "A or B": A is true (or present) and B is false (or absent); A is false (or absent) and B is true (or present); or both A and B are true (or present).

The first aspect of the present disclosure provides a micro-textured pet-hair-resistant yoga fabric. As shown in FIGS. 1-4, the fabric features a double-faced two-needle-bed knitted structure comprising a plurality of minimum stitch repeat units. Each minimum stitch repeat unit comprises 2 wale columns and 10-position course rows.

The structural unit formed by a first wale and the 10-position course rows is configured as follows: at positions 1, 4, 6, and 9 of the course row, the upper needle forms loop-forming stitch units, and the lower needle forms float stitch units. At positions 3, 5, and 8, the upper needle forms float stitch units, and the lower needle forms loop-forming stitch units. At position 2, the upper needle forms a tuck stitch unit, and the lower needle forms a float stitch unit. At positions 7 and 10, the upper needle forms float stitch units, and the lower needle forms tuck stitch units.

The structural unit formed by a second wale and the 10-position course rows is configured as follows: At positions 1, 4, 6, and 9, the upper needle forms loop-forming stitch units, and the lower needle forms float stitch units. At positions 2 and 5, the upper needle forms float stitch units, and the lower needle forms tuck stitch units. At position 7, the upper needle forms a tuck stitch unit, and the lower needle forms a float stitch unit. At positions 3, 8, and 10, the upper needle forms float stitch units, and the lower needle forms loop-forming stitch units.

In the aforementioned fabric, as shown in FIG. 1, the loop-forming stitch units formed by the upper needle at positions 1, 4, 6, and 9 of the 10-position course rows in the first wale column are dual-yarn loop-forming stitch units where two yarns are simultaneously knitted. The loop-forming stitch units formed by the lower needle at positions 3 and 8 of the 10-position course rows in the first wale column are also dual-yarn loop-forming stitch units. The loop-forming stitch unit formed by the lower needle at position 5 of the 10-position course rows in the first wale column is a single-yarn loop-forming stitch unit where one yarn is individually knitted. In the second wale column, the loop-forming stitch units formed by the upper needle at positions 1, 4, 6, and 9 of the 10-position course rows are dual-yarn loop-forming stitch units. The loop-forming stitch units formed by the lower needle at positions 3 and 8 of the 10-position course rows in the second wale column are dual-yarn loop-forming stitch units, while the loop-forming stitch unit formed by the lower needle at position 10 of the 10-position course rows in the second wale column is a single-yarn loop-forming stitch unit.

In the aforementioned fabric, the surface of the fabric exhibits a piqué-like texture.

In the aforementioned fabric, as shown in FIG. 1, the lower needle is a cylinder needle, and the upper needle is a dial needle.

The second aspect of the present disclosure provides a preparation method for a micro-textured pet-hair-resistant yoga fabric, comprising the following steps:

1) knitting yarns to form a grey fabric;
2) sequentially processing the grey fabric through scouring, pre-setting, dyeing, color fixation, rinsing, and post-setting to obtain the final fabric.

In step 1), the yarns include a first yarn component and a second yarn component, where the first component is a blended yarn and the second component is nylon.

In one embodiment, the blended yarn include the following components by weight percentage:

Nylon: 60-80%, such as 60-65%, 65-70%, 70-75%, and 75-80%;

Spandex: 20-40%, such as 20-25%, 25-30%, 30-35%, and 35-40%.

In some embodiments, the nylon is nylon 6, nylon 56, nylon 66, or a combination thereof.

In one embodiment, when a single type of yarn is employed for knitting, positions 1-4 and 6-9 of the 10-position course rows are knitted using the first yarn component, and positions 5 and 10 of the 10-position course rows are knitted using the second yarn component, and the nylon in the first and second yarn components are identical.

In some embodiments, the nylon is nylon 6, nylon 56, or nylon 66.

Specifically, positions 1-4 and 6-9 of the 10-position course rows are co-knitted using a nylon (e.g., nylon 6) blended with spandex, while positions 5 and 10 of the same course row are knitted exclusively with the same nylon type (e.g., nylon 6).

In one embodiment, when the yarns are knitted with two types of yarns, positions 1-4 and 6-9 of the 10-position course rows are knitted using the first yarn component, positions 5 and 10 are knitted using the second yarn component, and the nylon types in the first and second yarn components are different.

In one embodiment, the nylon used in the first yarn component is nylon 6, and the nylon used in the second yarn component is nylon 56.

Specifically, positions 1-4 and 6-9 of the 10-position course rows are co-knitted with nylon 6 and spandex, and positions 5 and 10 are knitted using nylon 56 alone.

In one embodiment, the quantity ratio between the first yarn component and the second yarn component is 4:1.

In step 1), the knitting process is performed by using a double-faced two-track circular knitting machine operating in a double-faced two-track knitting mode.

In one embodiment, in the double-faced two-track knitting mode, a dial and a cylinder are both provided with two-track needles. The dial needles adopt a BABA cyclic arrangement pattern, and the cylinder needles adopt an ABAB cyclic arrangement pattern. The cylinder needles function as lower needles, and the dial needles function as upper needles.

In one embodiment, in the double-faced two-track knitting mode, the knitting mode employs alternating high-heel and low-heel needles in both needle beds.

In one embodiment, in the double-faced two-track knitting mode, the upper needle and the lower needle are arranged alternately across the needle beds.

In step 1), the knitting process constructs a minimum stitch repeat unit comprising 2 wale columns and 10-position course rows through coordinated upper/lower needle actions. Multiple repeat units are then interconnected to form the grey fabric.

In one embodiment, the minimum stitch repeat unit is constructed as follows: for the first wale column interacting with the 10-position course rows, at positions 1, 4, 6, and 9, the upper needle forms loop-forming stitch units, and the lower needle forms float stitch units; at positions 3, 5, and 8, the upper needle forms float stitch units, and the lower needle forms loop-forming stitch units; at position 2, the upper needle forms a tuck stitch unit, and the lower needle forms a float stitch unit; at positions 7 and 10, the upper needle forms float stitch units, and the lower needle forms tuck stitch units. For the second wale column interacting with the 10-position course rows, at positions 1, 4, 6, and 9, the upper needle forms loop-forming stitch units, and the lower needle forms float stitch units; at positions 2 and 5, the upper needle forms float stitch units, and the lower needle forms tuck stitch units; at position 7, the upper needle forms a tuck stitch unit, and the lower needle forms a float stitch unit; at positions 3, 8, and 10, the upper needle forms float stitch units, and the lower needle forms loop-forming stitch units.

In one embodiment, for the first wale column interacting with the 10-position course rows, at positions 1, 4, 6, and 9, the upper needle forms dual-yarn loop-forming stitch units by co-knitting two yarns simultaneously; the lower needle at positions 3 and 8 forms dual-yarn loop-forming stitch units by co-knitting two yarns simultaneously; the lower needle at position 5 forms a single-yarn loop-forming stitch unit using one yarn. For the second wale column interacting with the 10-position course rows, the upper needle at positions 1, 4, 6, and 9 forms dual-yarn loop-forming stitch units by co-knitting two yarns simultaneously; the lower needle at positions 3 and 8 forms dual-yarn loop-forming stitch units by co-knitting two yarns simultaneously; and the lower needle at position 10 forms a single-yarn loop-forming stitch unit using one yarn.

In step 2), the scouring process includes ultrasonic treatment of the grey fabric in hot water to remove oils and impurities.

In one embodiment, the temperature of the hot water ranges from 60 to 70° C., such as 60-65° C. and 65-70° C., and preferably 65° C.

In one embodiment, the ultrasonic scouring operates at a frequency of 25-35 kHz, such as 25-30 kHz and 30-35 kHz, and preferably 30 kHz.

In one embodiment, the ultrasonic power density ranges from 0.1 to 1.2 W/cm$^2$, preferably 0.3-1.0 W/cm$^2$, adjusted based on the fabric thickness and oil content.

In step 2), the pre-setting process is conducted at an ambient temperature ranging from 190 to 205° C., preferably 195-200° C.

In step 2), the pre-setting process is conducted at a fabric feed speed of 15-25 m/min, preferably 19-21 m/min.

In step 2), the pre-setting process includes three sequential sections along the fabric feed direction: a pre-drying zone, a first drying zone, and a second drying zone. The temperature of the pre-drying zone ranges from 155 to 175° C., preferably 160-170° C.; the temperature of the first drying zone ranges from 185 to 195° C., such as 185-190° C. and 190-195° C., preferably 190° C.; the temperature of the second drying zone ranges from 176 to 184° C., such as 176-180° C. and 180-184° C., preferably 180° C.

In one embodiment, the pre-drying zone is further divided into four sequential sections along the fabric feed direction: a first pre-drying section, a second pre-drying section, a third pre-drying section, and a fourth pre-drying section. The temperature of the first pre-drying section ranges from 155 to 165° C., such as 155-160° C. and 160-165° C., preferably 160° C.; the temperature of the second pre-drying section ranges from 155 to 165° C., such as 155-160° C. and 160-165° C., preferably 160° C.; the temperature of the third pre-drying section ranges from 165 to 175° C., such as 165-170° C. and 170-175° C., preferably 170° C.; the temperature of the fourth pre-drying section ranges from 165 to 175° C., such as 165-170° C. and 170-175° C., preferably 170° C.

In one embodiment, the first drying zone is further divided into the first to the fourth sections sequentially along the fabric feed direction. The temperatures of the first to the fourth sections of the first drying zone range from 185-195° C., respectively, such as 185-190° C., 190-195° C., and preferably 190° C.

In one embodiment, the second drying zone is further divided into a first section and a second section sequentially along the fabric feed direction. The temperatures of the first section and the second section of the second drying zone range from 176 to 184° C., respectively, such as 176-180° C. and 180-184° C., preferably 180° C.

The first to fourth sections of the pre-drying zone, the first to the fourth sections of the first drying zone, and the first section and the second of the second drying zone of the second drying zone are all drying ovens. That is, 10 drying ovens are provided.

In one embodiment, the pre-setting process is conducted in a conventional fabric setting machine where the lower air volume exceeds the upper air volume. The grey fabric is positioned to avoid direct contact with both upper and lower air outlets during treatment.

In step 2), the dyeing process is performed in an overflow dyeing machine, specifically a standard high-temperature high-pressure jet overflow dyeing machine.

In step 2), the dyeing process includes immersing the pre-set fabric in a dye bath containing dyes, acetic acid, and leveling agents.

In one embodiment, the dyes may be a dye conventionally used for dyeing the grey fabric, such as a nylon dyeable dye.

In one embodiment, the nylon dyeable dye is a nylon dyeable acid dye, a nylon dyeable disperse dye, or a nylon dyeable neutral dye.

In one embodiment, the nylon dyeable dye is a nylon dyeable acid dye, preferably an azo nylon dyeable acid dye.

In one embodiment, the leveling agent may be a leveling agent conventionally used for dyeing the grey fabric, such as an acid dye leveling agent.

In one embodiment, the acid dye leveling agent is an anionic fiber-affinitive leveler for acid dyes, or nonionic/amphoteric surfactant-type dye-affinitive agents for acid dyes, and preferably the nonionic/amphoteric surfactant-type dye-affinitive agents for acid dyes.

In one embodiment, the weight ratio of the dye to the grey fabric is 0.01-0.03:1, such as 0.01-0.02:1, 0.02-0.03:1, and preferably 0.02:1.

In one embodiment, the weight ratio of a dye liquor (prepared by mixing dye with water) to the grey fabric is 8-15:1, such as 8-10:1, 10-15:1, and preferably 10:1.

In one embodiment, the weight ratio of the leveling agent to the grey fabric is 0.003-0.005:1, such as 0.003-0.004:1, 0.004-0.005:1, and preferably 0.004:1.

In one embodiment, the dyeing process is conducted at a pH of 4-7, adjusted using acetic acid. When dyeing a light color, the pH value should be controlled between 5-7, and when dyeing a dark color, the pH value should be controlled between 4-6.

In one embodiment, the acetic acid is used as an aqueous solution, and the ratio of the weight (g) of acetic acid to the volume (L) of water in the acetic acid aqueous solution is 2-3:1, such as 2-2.5:1, 2.5-3:1, and preferably 2.5:1.

In step 2), the temperature of the dyeing ranges from 55 to 95° C., such as 55-60° C., 60-90° C., 90-95° C., and preferably 60-90° C.

In step 2), the duration of the dyeing is 30+10 min, preferably 30+5 min.

In step 2), the color fixation includes treating the dyed fabric with a color-fixing agent and acetic acid.

In one embodiment, the color-fixing agent may be a conventional agent used for fixing color on grey fabric, such as a formaldehyde-free acid color-fixing agent.

In one embodiment, the weight ratio of the color-fixing agent to the grey fabric is 0.04-0.06:1, such as 0.04-0.05:1, 0.05-0.06:1, preferably 0.05:1.

In one embodiment, the pH value during the color fixation is 2.5-6, adjusted using acetic acid.

In one embodiment, the acetic acid is an acetic acid aqueous solution, and the ratio of the weight (g) of acetic acid to the volume (L) of water in the acetic acid aqueous solution is 0.4-0.6:1, such as 0.4-0.5:1, 0.5-0.6:1, preferably 0.5:1.

In step 2), the temperature of the color fixation ranges from 60 to 80° C., such as 60-65° C., 65-75° C., 75-80° C., and preferably 65-75° C.

In step 2), the duration of the color fixation is 30+10 min, preferably 30+5 min.

In step 2), the rinsing includes washing the fabric after color fixation with clean water until the effluent runs clear, indicating completion.

In step 2), the post-setting includes dehydrating the rinsed semi-finished fabric followed by a low-temperature setting to obtain the final fabric with a uniform surface, stabilized width, and consistent weight.

In one embodiment, the centrifugal speed of dehydration is not less than 1000 r/min. The fabric is dehydrated using a high-speed industrial dehydrator until residual moisture is expelled.

In one embodiment, the temperature of the post-setting ranges from 105 to 115° C., such as 105-110° C., 110-115° C., and preferably 110° C.

In one embodiment, the feed speed of the post-setting is 29-31 m/min, preferably 30 m/min.

In one embodiment, the post-setting is performed in the drying oven of a conventional fabric setting machine, with upper/lower airflows set to 55-65% (including 55-60% and 60-65%, preferably 60%). The fabric is prevented from contacting the oven floor during processing.

In one embodiment, the length of the drying oven is 20-30 m, such as 20-24 m and 24-30 m, preferably 24 m.

In step 2), the fabric undergoes inspection and packaging after the post-setting.

In one embodiment, the fabric inspection is performed using a conventional fabric inspection machine.

In one embodiment, the packaging includes sealing the fabric in light-blocking materials before storage.

The third aspect of the present disclosure provides a micro-textured pet-hair-resistant yoga fabric prepared by the above preparation method.

The fourth aspect of the present disclosure provides the use of a micro-textured pet-hair-resistant yoga fabric in pet-hair-resistant clothing.

This fabric can reduce the direct contact area with pet hair. Specifically, assuming that a piqué-textured area (assigned unit area=1) interlaces with a flat area (unit area=1). A basic repeat unit comprises 2 piqué-textured areas and 2 flat areas, resulting in a direct fabric-to-hair contact ratio of: 1×2/2+2=50%. This 50% reduction in contact area effectively minimizes pet hair adhesion.

The following examples illustrate specific implementations of the present disclosure. Those skilled in the art may readily extrapolate other advantages and operational efficiencies from the disclosed content. The present disclosure may also be adapted or applied through additional embodiments, with modifications or variations permissible within the inventive scope as defined by the claims.

In the following embodiments, unless otherwise specified, raw materials or processing techniques are conventional commercially available conventional products or standard industry practices.

Embodiment 1

The grey fabric was prepared by knitting on a double-faced two-track circular knitting machine. A minimum stitch repeat unit was formed through two wale columns and their corresponding 10-position course rows created by coordinated upper and lower needle actions. Multiple repeat units were interconnected to construct the fabric surface, to obtain a grey fabric sample 1 #.

A structural unit formed by a first wale and the 10-position course rows was configured as follows: at positions 1, 4, 6, and 9 of the 10-position course rows, an upper needle formed loop-forming stitch units, and a lower needle formed float stitch units; at positions 3, 5, and 8, an upper needle formed float stitch units, and a lower needle formed loop-forming stitch units; at position 2, an upper needle formed a tuck stitch unit, and a lower needle formed a float stitch unit; at positions 7 and 10, an upper needle formed float stitch units, and a lower needle formed tuck stitch units. A structural unit formed by a second wale and the 10-position course rows was configured as follows: at positions 1, 4, 6, and 9, an upper needle formed loop-forming stitch units, and a lower needle formed float stitch units; at positions 2 and 5, an upper needle formed float stitch units, and a lower needle formed tuck stitch units; at position 7, an upper needle formed a tuck stitch unit, and a lower needle formed a float stitch unit; at positions 3, 8, and 10, an upper needle formed float stitch units, and a lower needle formed loop-forming stitch units. Therefore, a minimum stitch repeat unit was obtained.

For the first wale column interacting with the 10-position course rows, the upper needle at positions 1, 4, 6, and 9 formed dual-yarn loop-forming stitch units by co-knitting two yarns simultaneously; the lower needle at positions 3 and 8 formed dual-yarn loop-forming stitch units by co-knitting two yarns simultaneously; the lower needle at position 5 formed a single-yarn loop-forming stitch unit using one yarn; for the second wale column interacting with the 10-position course rows, the upper needle at positions 1, 4, 6, and 9 formed dual-yarn loop-forming stitch units by co-knitting two yarns simultaneously; the lower needle at positions 3 and 8 formed dual-yarn loop-forming stitch units by co-knitting two yarns simultaneously; and the lower needle at position 10 formed a single-yarn loop-forming stitch unit using one yarn. Thereby the minimum stitch repeat units were obtained.

The yarns include a first yarn component and a second yarn component. The first yarn component was blended yarn, and the second yarn part was nylon. The blended yarn includes the following components by weight: 70% nylon and 30% spandex. The yarns were knitted with two types of yarns, positions 1-4 and 6-9 of the 10-position course rows were knitted using the first yarn component, and positions 5 and 10 were knitted using the second yarn component. The nylon used in the first yarn component was nylon 6, i.e., the first yarn component was the blended yarn of nylon 6 and spandex, and the nylon used in the second yarn component was nylon 56. The quantity ratio of the first yarn component to the second yarn component was 4:1.

In the double-faced two-track knitting mode, A dial and a cylinder were both provided with two-track needles. The dial needles adopted a BABA cyclic arrangement pattern, and the cylinder needles adopted an ABAB cyclic arrangement pattern. The knitting mode employs alternating high-heel and low-heel needles in both needle beds. The upper and lower needles were arranged alternately.

The grey fabric sample 1 #underwent ultrasonic scouring in 65° C. hot water with a fixed ultrasonic frequency of 30 KHz and power density of 0.7 W/cm$^2$.

Subsequently, the grey fabric sample 1 # was pre-setting in a setting machine at 197° C. with a feed speed of 20 m/min, utilizing a 10-compartment drying oven system. The 10-compartment drying oven system was divided into a pre-drying zone, a first drying zone, and a second drying zone. The pre-drying zone was further divided into four sequential sections along the fabric feed direction: a first pre-drying section, a second pre-drying section, a third pre-drying section, and a fourth pre-drying section. The temperature of the first pre-drying section was 160° C.; the temperature of the second pre-drying section was 160° C.; the temperature of the third pre-drying section was 170° C.; the temperature of the fourth pre-drying section was 170° C. The first drying zone was further divided into four sections sequentially along the fabric feed direction, and the temperatures of the first to the fourth sections of the first drying zone were 190° C. The second drying zone was further divided into a first section and a second section sequentially along the fabric feed direction; the temperatures of the first section and the second section of the second drying zone were both 180° C. The setting machine was configured with a greater air volume in the lower airflow zone compared to the upper airflow zone, while ensuring the fabric surface avoided contact with both upper and lower air outlets during processing.

The grey fabric sample 1 # was then subjected to dyeing in an overflow dyeing machine at 75° C. for 30 minutes, using a dyeing solution of a dye, acetic acid, and a leveling agent. The dye was azo-based acid-dyeable nylon dye, and the leveling agent was a nonionic/amphoteric surfactant-type leveling agent. The weight ratio of the dye to the grey fabric was 0.02:1, and the weight ratio of a dye liquor (dye mixed with water) to the fabric was 10:1. The weight ratio of the leveling agent to the grey fabric was 0.004:1, the ratio of the weight (g) of acetic acid to the volume (L) of water was 2.5:1, and the pH of the dyeing solution was adjusted to 5.

The grey fabric sample 1 # was then subjected to color fixation at 70° C. for 30 minutes, using a fixation solution including a formaldehyde-free acid color-fixing agent and acetic acid. The weight ratio of the color-fixing agent to grey fabric was 0.05:1. The ratio of acetic acid weight (g) to water volume (L) was 0.5:1, and the pH of the fixation solution was adjusted to 5.

The grey fabric sample 1 # was rinsed once with clean water after fixation, dehydrated in a centrifuge at 1000 r/min, and then post-set in a setting machine. The post-setting process operated at a feed speed of 30 m/min, with a drying oven length of 24 m, a temperature of 110° C., and upper/lower airflow set to 60%. During post-setting, the fabric was kept from contacting the bottom of the drying oven, thereby the fabric sample 1 # was obtained.

Finally, the fabric sample 1 # was manually inspected using a fabric inspection machine. Upon passing inspection, it was packaged with light-blocking materials and stored.

Embodiment 2

The grey fabric sample 2 # was knitted using a double-faced two-track circular knitting machine via a double-faced two-track knitting process. A minimum stitch repeat unit was formed by two wale columns and their corresponding 10-course rows through coordinated upper and lower needle actions. Multiple repeat units were interconnected to construct the fabric surface, thereby obtaining grey fabric sample 2 #. The structure of the minimum repeat unit was identical to that in Embodiment 1.

The fabric was knitted using blended yarns comprising (by weight) 75% nylon and 25% spandex. Two types of yarns were employed, with compositions identical to Embodiment 1. The double-faced two-track knitting conditions were consistent with Embodiment 1.

The grey fabric sample 2 # was subjected to ultrasonic scouring in 62° C. hot water with an ultrasonic frequency of 33 kHz and power density of 0.9 W/cm$^2$.

Then the grey fabric sample 2 # was pre-set in the setting machine at a temperature of 195° C. with a feed speed of 21 m/min, utilizing a 10-compartment drying oven system. The 10-compartment drying oven system was divided into a pre-drying zone, a first drying zone, and a second drying zone. The pre-drying zone was further divided into four sequential sections along the fabric feed direction: a first pre-drying section, a second pre-drying section, a third pre-drying section, and a fourth pre-drying section. The temperature of the first pre-drying section was 162° C.; the temperature of the second pre-drying section was 162° C.; the temperature of the third pre-drying section was 173° C.; the temperature of the fourth pre-drying section was 173° C. The first drying zone was further divided into four sections sequentially along the fabric feed direction, and the temperatures of the first to the fourth sections of the first drying zone were 194° C. The second drying zone was further divided into a first section and a second section sequentially along the fabric feed direction; the temperatures of the first section and the second section of the second drying zone were both 182° C. The setting machine was configured with a greater air volume in the lower airflow zone compared to the upper airflow zone, while ensuring the fabric surface avoided contact with both upper and lower air outlets during processing.

The grey fabric sample 2 # was then subjected to dyeing in an overflow dyeing machine at 70° C. for 35 minutes, using a dyeing solution of a dye, acetic acid, and a leveling agent. The dye was azo-based acid-dyeable nylon dye, and the leveling agent was a nonionic/amphoteric surfactant-type leveling agent. The weight ratio of the dye to the grey fabric was 0.03:1, and the weight ratio of a dye liquor (dye mixed with water) to the fabric was 12:1. The weight ratio of the leveling agent to the grey fabric was 0.005:1, the ratio of the weight (g) of acetic acid to the volume (L) of water was 2.0:1, and the pH of the dyeing solution was adjusted to 6.

The grey fabric sample 2 # was then subjected to color fixation at 74° C. for 25 minutes, using a fixation solution including a formaldehyde-free acid color-fixing agent and acetic acid. The weight ratio of the color-fixing agent to grey fabric was 0.06:1. The ratio of acetic acid weight (g) to water volume (L) was 0.6:1, and the pH of the fixation solution was adjusted to 5.5.

The grey fabric sample 2 # was rinsed once with clean water after fixation, dehydrated in a centrifuge at 1200 r/min, and then post-set in a setting machine. The post-setting process operated at a feed speed of 29 m/min, with a drying oven length of 22 m, a temperature of 115° C., and upper/lower airflow set to 64%. During post-setting, the fabric was kept from contacting the bottom of the drying oven, thereby the fabric sample 2 # was obtained.

Finally, fabric sample 2 # was manually inspected using a fabric inspection machine, packaged in light-blocking materials, and stored.

Embodiment 3

The grey fabric sample 3 # was knitted using a double-faced two-track circular knitting machine via a double-faced two-track knitting process. A minimum stitch repeat unit was formed by two wale columns and their corresponding 10-course rows through coordinated upper and lower needle actions. Multiple repeat units were interconnected to construct the fabric surface, thereby obtaining grey fabric sample 3 #. The structure of the minimum repeat unit was identical to that in Embodiment 1.

The fabric was knitted using blended yarns including a first yarn component and a second yarn component. The first component was a blended yarn including (by weight) 65% nylon and 35% spandex, and the second component was nylon. A single type of yarn was employed for knitting, positions 1-4 and 6-9 of the 10-position course rows were knitted using the first yarn component, and positions 5 and 10 of the 10-position course rows were knitted using the second yarn component. The nylon used in the first yarn component was nylon 6, i.e., the first yarn component was the blended yarn of nylon 6 and spandex, and the nylon used in the second yarn component was nylon 6. The double-faced two-track knitting conditions were consistent with Embodiment 1.

The grey fabric sample 3 # was subjected to ultrasonic scouring in 68° C. hot water with an ultrasonic frequency of 28 kHz and power density of 0.5 W/cm$^2$.

Then the grey fabric sample 3 # was pre-set in the setting machine at a temperature of 199° C. with a feed speed of 19 m/min, utilizing a 10-compartment drying oven system. The 10-compartment drying oven system was divided into a pre-drying zone, a first drying zone, and a second drying zone. The pre-drying zone was further divided into four sequential sections along the fabric feed direction: a first pre-drying section, a second pre-drying section, a third pre-drying section, and a fourth pre-drying section. The temperature of the first pre-drying section was 157° C.; the temperature of the second pre-drying section was 157° C.; the temperature of the third pre-drying section was 168° C.; the temperature of the fourth pre-drying section was 168° C. The first drying zone was further divided into four sections sequentially along the fabric feed direction, and the temperatures of the first to the fourth sections of the first drying zone were 187° C. The second drying zone was further divided into a first section and a second section sequentially along the fabric feed direction; the temperatures of the first section and the second section of the second drying zone were both 176° C. The setting machine was configured with a greater air volume in the lower airflow zone compared to the upper airflow zone, while ensuring the fabric surface avoided contact with both upper and lower air outlets during processing.

The grey fabric sample 3 # was then subjected to dyeing in an overflow dyeing machine at 80° C. for 25 minutes, using a dyeing solution of a dye, acetic acid, and a leveling agent. The dye was azo-based acid-dyeable nylon dye, and the leveling agent was a nonionic/amphoteric surfactant-type leveling agent. The weight ratio of the dye to the grey fabric was 0.01:1, and the weight ratio of a dye liquor (dye mixed with water) to the fabric was 8:1. The weight ratio of the leveling agent to the grey fabric was 0.003:1, the ratio of the weight (g) of acetic acid to the volume (L) of water was 3.0:1, and the pH of the dyeing solution was adjusted to 6.5.

The grey fabric sample 3 # was then subjected to color fixation at 67° C. for 35 minutes, using a fixation solution including a formaldehyde-free acid color-fixing agent and acetic acid. The weight ratio of the color-fixing agent to grey fabric was 0.04:1. The ratio of acetic acid weight (g) to water volume (L) was 0.4:1, and the pH of the fixation solution was adjusted to 4.

The grey fabric sample 3 # was rinsed once with clean water after fixation, dehydrated in a centrifuge at 1500 r/min, and then post-set in a setting machine. The post-setting process operated at a feed speed of 31 m/min, with a drying oven length of 28 m, a temperature of 106° C., and upper/lower airflow set to 58%. During post-setting, the fabric was kept from contacting the bottom of the drying oven, thereby the fabric sample 3 # was obtained.

Finally, fabric sample 3 # was manually inspected using a fabric inspection machine, packaged in light-blocking materials, and stored.

Test 1

Figure 2:
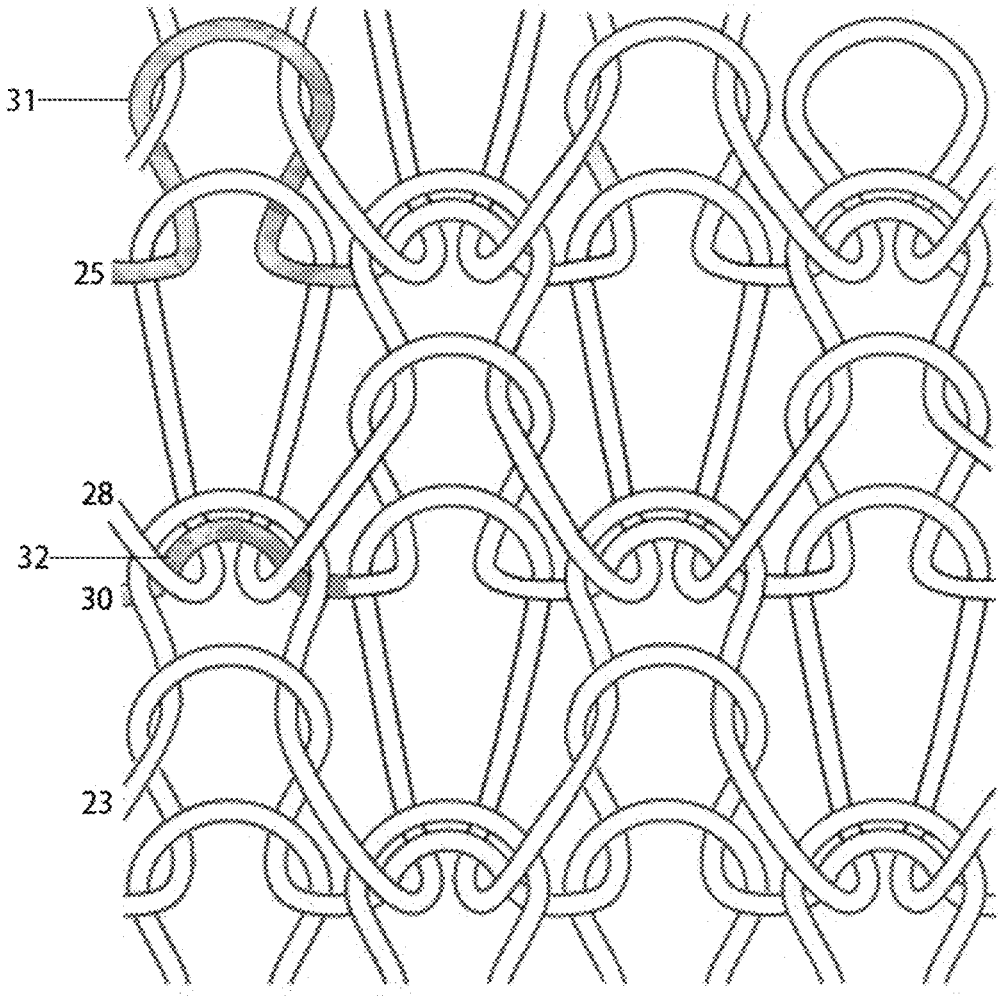
FIG. 2 shows the front-view line diagram of a piqué appearance of a micro-textured pet-hair-resistant yoga fabric in the present disclosure, where 31 represents loop-forming stitch units; 32 represents tuck stitch units; 23 represents position 3 of the 10-position course rows; 25 represents position 5 of the 10-position course rows; 28 represents position 8 of the 10-position course rows; and 30 represents position 10 of the 10-position course rows.
Figure 3:
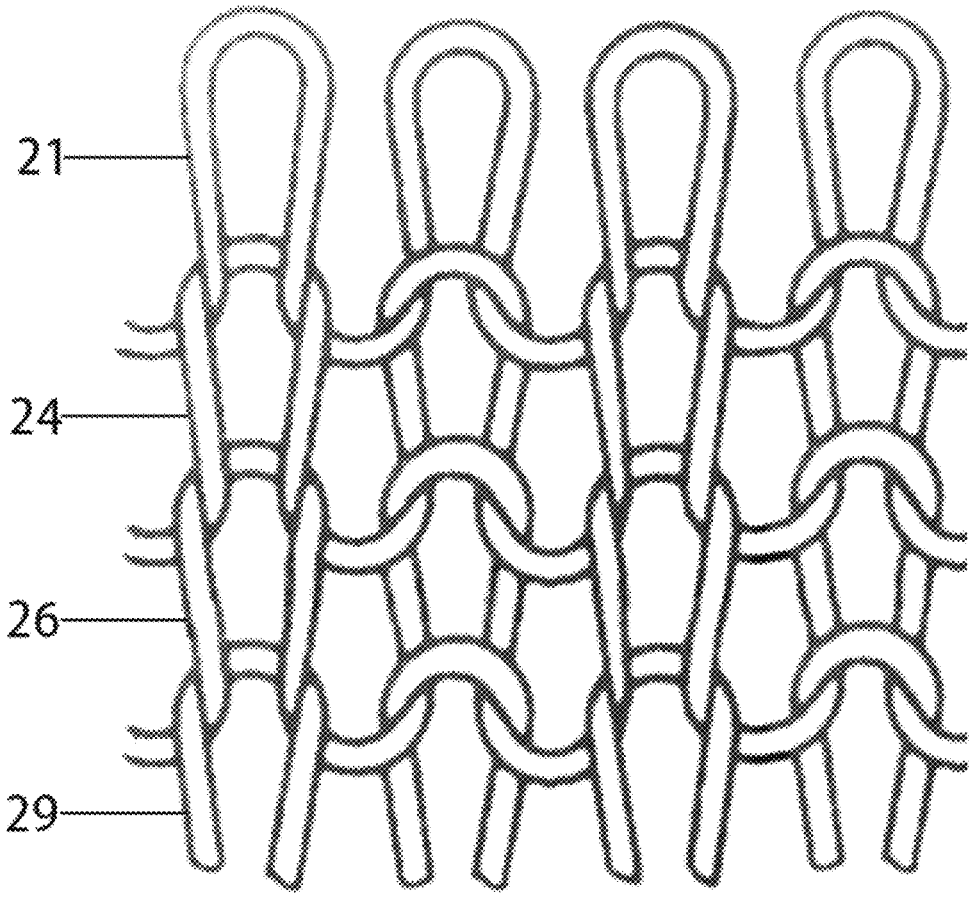
FIG. 3 illustrates the reverse plain-weave side line diagram of a micro-textured pet-hair-resistant yoga fabric of the present disclosure, wherein 21 represents position 1 of the 10-position course rows; 24 represents position 4 of the 10-position course rows; 26 represents position 6 of the 10-position course rows; and 29 represents position 9 of the 10-position course rows.
Figure 4:
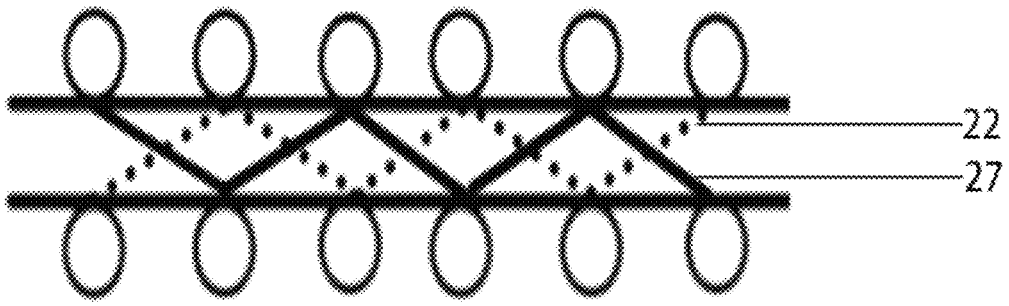
FIG. 4 is a cross-sectional schematic of the loop structure in a micro-textured pet-hair-resistant yoga fabric of the present disclosure, where 22 represents position 2 of the 10-position course rows, and 27 represents position 7 of the 10-position course rows.

The fabric sample 1 #obtained in Embodiment 1 exhibited the structure shown in FIGS. 1-4. In FIGS. 1 and 3, positions 1, 4, 6, and 9 (labeled 21, 24, 26, 29) of the 10-course rows formed the fabric's reverse side (plain surface). In FIGS. 1 and 2, positions 3, 5, 8, and 10 (labeled 23, 25, 28, 30) of the 10-course rows formed the fabric's face side (pique-textured surface). In FIGS. 1 and 4, positions 2 and 7 (labeled 22, 27) of the 10-course rows constituted the intermediate layer of the fabric, interlocking the face and reverse sides.

As shown in FIGS. 2, 3, and 4, the three-dimensional stitch configuration of fabric sample 1 # was observed. In FIG. 2, position 5 (labeled 25) of the 10-course rows formed the first stitch unit as a loop-forming stitch unit; position 8 (labeled 28) formed the first stitch unit as a loop-forming stitch unit; position 10 (labeled 30) formed the first stitch unit as a tuck stitch unit; position 3 (labeled 23) formed the first stitch unit as a loop-forming stitch unit. The first tuck stitch unit at position 10 (30) was looped over the first loop-forming stitch unit at position 8 (28). The first loop-forming stitch unit at position 3 (23) was also looped over the same loop-forming stitch unit at position 8th (28), pulling its base and compressing the tuck stitch unit at position 10 (30), thereby forming the protruding piqué texture. Conversely, the first loop-forming stitch unit at position 5 (25) interlooped with the first loop-forming stitch unit at position 8 (28), generating flat zones that alternated orthogonally with the piqué-textured areas. This configuration achieved the desired fabric surface morphology.

Test 2

The pet hair adhesion resistance test was performed on fabric samples using cat hair as the test material.

Two pieces of fabric sample 1 # from Embodiment 1 (approximately 35 cm××55 cm each) were cut with the long edge aligned parallel to the fabric's length direction. Each sample was folded along the short edge and sewn into a tubular sleeve. The tubular fabric sample 1 # was worn on the forearm by Tester 1. Approximately 0.02 g of cat hair was dispersed into individual strands using a comb and sprinkled onto the fabric. Tester 1's arm was held vertically while Tester 2 grasped Tester 1's elbow with one hand and flapped the fabric 5-10 times toward the fingertips with the other hand. The residual hair on the fabric surface was observed. The test criteria required no remaining pet hair on the fabric after flapping.

Through third-party testing, the results (Table 1) showed that zero hairs remained on fabric sample 1 # after 5-10 flaps, confirming its pet hair-resistant properties.

TABLE 1

Adhesion Resistance To Animal Hairs
In-House method for HALARA
Test Condition
Flapping Times: After Flapping For 5~10 Times

| | Result | |
|---|---|---|
| | Hairs of Animal Result Observation | (cat)# REQ Observation |
| 1 | No animal hairs were found on the sample after flapping. | No animal hairs were found on the sample after flapping. |
| 2 | General Appearance: Acceptable. | |

Test 3

Fabric sample 1 # from Embodiment 1 was tested according to AATCC 124-2001 (Appearance of Fabrics After Repeated Home Laundering). Specifically, the fabric was laundered via home washing procedures and evaluated for surface smoothness.

The test equipment and materials included an automatic washing machine, an automatic tumble dryer, drip-drying and line-drying equipment, a 9.5 L container, 1993 AATCC standard detergent, ballast cloths, an illuminated and rating area, suspended fluorescent lighting fixtures, AATCC 3D Smoothness Reference Scales, an iron, and a laboratory balance.

Three 38 cm×38 cm fabric samples 1 # were prepared, each containing different warp and weft yarns, with the length direction marked.

The water temperature was selected according to the specified water level and maintained below 29° C. 66.0+0.1 g of 1993 AATCC standard detergent was added. The washing cycle and duration were set, and the samples with sufficient ballast cloths were loaded into the machine. The samples were dried according to the selected procedure (e.g., Procedure A: tumble-drying; Procedure B: line-drying; Procedure D: flat-drying). For tumble-drying, the samples and ballast cloths were placed into the dryer and removed immediately after the cycle ended to prevent adhesion to the dryer.

Prior to rating, the samples were preconditioned at 21±1° C. and 65±2% RH for at least 4 hours per ASTM D1776.

The samples were hung with two corners fixed, ensuring the length direction was perpendicular to the horizontal plane. The smoothness grade level for fabric surface appearance (SA) image evaluation is provided in Table 2 below. Results (Table 2) indicated that fabric sample 1 # from Embodiment 1 achieved Grade 3.5 or higher, demonstrating wrinkle-resistant performance.

TABLE 2

| Grade Level | Description |
|---|---|
| SA-5 | Exceptionally smooth with no creases |
| SA-4 | Uniform smoothness |
| SA-3.5 | Moderately smooth |
| SA-3 | Irregular texture |
| SA-2 | Pronounced wrinkling |
| SA-1 | Severe wrinkling |

The above descriptions are merely preferred embodiments of the present disclosure and shall not be construed as limitations to the present disclosure. It should be noted that for those skilled in the art, several improvements and supplements may be made without departing from the technical solution of the present disclosure, which shall also be regarded as falling within the protection scope of the present invention. Those skilled in the art may utilize the technical content disclosed above to make minor alterations, modifications, and equivalent changes in practice without departing from the scope of the present invention, which shall be deemed as equivalent embodiments of the present invention. Meanwhile, any equivalent alterations, modifications, and changes made to the aforementioned embodiments based on the essential technology of the present invention shall still belong to the scope of the technical solutions of the present invention.

What is claimed is:

1. A micro-textured pet-hair-resistant yoga fabric, wherein the fabric features a double-faced two-needle-bed knitted structure comprising a plurality of minimum stitch repeat units, each minimum stitch repeat unit comprises 2 wale columns and 10-position course rows;

wherein a structural unit formed by a first wale and the 10-position course rows is configured as follows: at positions 1, 4, 6, and 9 of the 10-position course rows, an upper needle forms loop-forming stitch units, and a lower needle forms float stitch units; at positions 3, 5, and 8, an upper needle forms float stitch units, and a lower needle forms loop-forming stitch units; at position 2, an upper needle forms a tuck stitch unit, and a lower needle forms a float stitch unit; at positions 7 and 10, an upper needle forms float stitch units, and a lower needle forms tuck stitch units;

wherein a structural unit formed by a second wale and the 10-position course rows is configured as follows: at positions 1, 4, 6, and 9, an upper needle forms loop-forming stitch units, and a lower needle forms float stitch units; at positions 2 and 5, an upper needle forms float stitch units, and a lower needle forms tuck stitch units; at position 7, an upper needle forms a tuck stitch unit, and a lower needle forms a float stitch unit; at positions 3, 8, and 10, an upper needle forms float stitch units, and a lower needle forms loop-forming stitch units.

* * * * *